United States Patent [19]

Ke

[11] Patent Number: 4,846,430

[45] Date of Patent: Jul. 11, 1989

[54] DOOR BACK HANGING ORGANIZER DEVICE

[76] Inventor: Yeoug-Sh Ke, No. 3-1, Lane 125, Hsin Jen Rd., Sec. 1, Ta Li Hsiang, Taichung Hsien, Taiwan

[21] Appl. No.: 216,686

[22] Filed: Jul. 8, 1988

[51] Int. Cl.[4] ..... A47F 5/00

[52] U.S. Cl. ..... 248/215; 211/87; 211/94.5

[58] Field of Search ..... 248/200.1, 200, 201, 248/225.31, 295.1, 309.1, 317, 323, 327, 215, 214; 211/87, 105.1, 113, 35, 94.5, 86

[56] References Cited

U.S. PATENT DOCUMENTS

| | | | |
|---|---|---|---|
| 846,784 | 3/1907 | Davis | 248/215 |
| 1,942,444 | 1/1934 | O'Conner | 248/201 |
| 2,270,796 | 1/1942 | Hauser | 211/86 |
| 2,428,073 | 9/1947 | Handel | 211/87 |
| 2,673,705 | 3/1954 | Buckley | 248/317 |
| 2,925,916 | 2/1960 | Pollock | 211/86 |
| 2,985,417 | 5/1961 | Thompson | 248/214 |
| 3,198,343 | 8/1985 | Pollock | 211/87 |
| 3,355,030 | 11/1967 | Cathcart | 211/87 |

FOREIGN PATENT DOCUMENTS

| | | | |
|---|---|---|---|
| 2383581 | 11/1978 | France | 211/105.1 |
| 1278118 | 6/1972 | United Kingdom | 248/215 |

*Primary Examiner*—Alvin C. Chin-Shue
*Assistant Examiner*—Robert A. Olson
*Attorney, Agent, or Firm*—Varndell Legal Group

[57] ABSTRACT

A door back hanging organizer device comprising an upper locating plate, an lower locating plate, belt, and a fixing plate. The upper and lower locating plates are respectively located at the both ends of the belt, each of locating plate having two lines of bending holes for selective bending of the locating plate at either line of the bending holes into an inverted U-shaped configuration for convenient fixation of the locating plate on the top and bottom of a door body. The belt can be adjusted for length and tension. The fixing plate has two slots at upper and lower ends and a hook with a channel at the upper rear end thereof. Two devices can be used together with the fixing plates being arranged respectively at right and left sides of the door installation of a cross hanging rod and a net bag therebetween by way of the channel in two hooks appropriately arranged on the right and left devices. Accessories, such as a hanging ring, can be attached to the device by way of the hooks.

7 Claims, 3 Drawing Sheets

10
22
12

20
21
10
30
12

12
24
23
13
36
26
25
14
15
32
12
13
26

16
31
32

11

DOOR BACK HANGING ORGANIZER DEVICE

BACKGROUND AND SUMMARY OF THE INVENTION

In order to fully make use of space and for the sake of convenience, people nail hanging hooks or adhere suspensions to the wall of a bedroom or bathroom or the inner side of a door for hanging clothes or some other articles. Regular hanging hooks are attached to the wall by means of nails, screws, or an adhesive agent, which may cause the following problems: (1) Attachment by means of nails or screws is difficult and it is easy to damage the door body or the wall thus destroying its outer appearance. (2) Attachment by means of an adhesive agent may not damage the door body or the wall, but it is not secure and can easily separate from the door or wall.

In view of the above-mentioned problems and after a long period of experimentation and improvement, the present invention was finally created by the present inventor to provide a simple, but convenient, hanging device for wide application.

The main object of the present invention is to make use of belt, locating plates, fixing plates and cross hanging rods, and by means of flexible arrangement, provide a variety of simple but convenient and secure hanging devices for hanging clothes and articles, which do not damage the door body and which do not easy fall from the door.

Another object of the present invention is to make use of a special locating plate comprising two lines of bending holes at both ends for easy installation of the present hanging device on all doors of different thickness by means of selective bending of the location plate at either line of the bending holes.

A further object of the present invention is to make use of a fixing plate comprising an upper slot and a lower slot for installation on the belt of the present hanging device. By the arrangement of one pair of the fixing plates each having a hook respectively allocated at right and left sides of a door, a cross hanging rod can be attached therebetween through an upper slot within each hook. A net bag or the like can be attached to and firmly allocated at the cross rod for application.

BRIEF DESCRIPTION OF THE DRAWINGS

FIG. 1 is a fragmentary perspective view of a hanging organizer device embodying the present invention.

FIG. 1-1 illustrates the attachment of the belt with a door plate.

FIG. 1-2 illustrates the attachment of the belt with the fixing plate.

FIG. 1-3 is an enlarged perspective view of the clamping of the net bag according to the present invention.

FIG. 1-4 is an enlarged perspective view of the connecting end of the belt according to the present invention.

FIG. 2 illustrates the application of the preferred embodiment according to the present invention for double-adjust hanging device.

FIG. 3 illustrates the application of the preferred embodiment according to the present invention for single-adjust hanging device.

FIG. 4 illustrates the application of the preferred embodiment according to the present invention including a net bag.

DETAILED DESCRIPTION OF THE PREFERRED EMBODIMENT

Figures 1, 2, 3, 4:
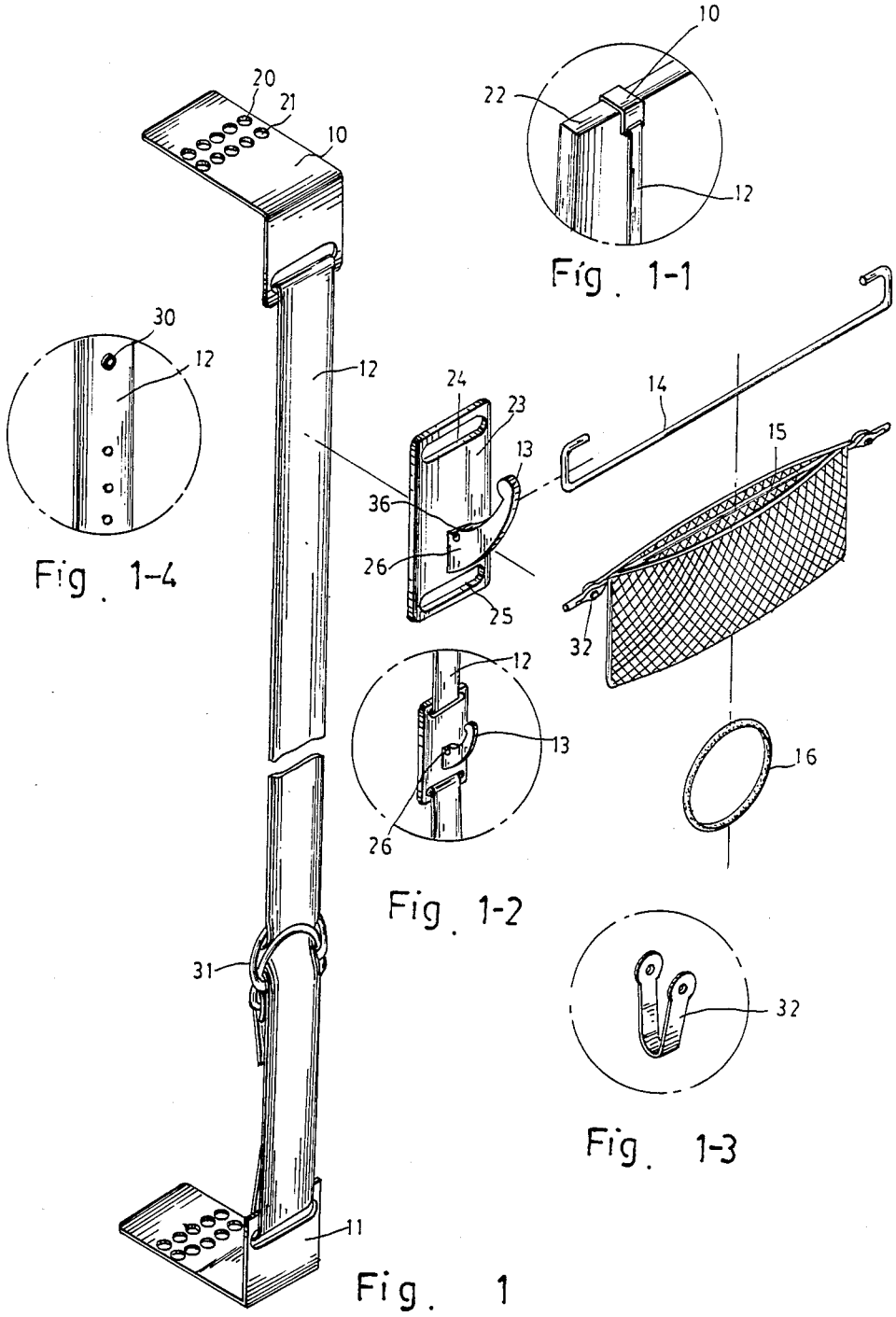
Figure 2:
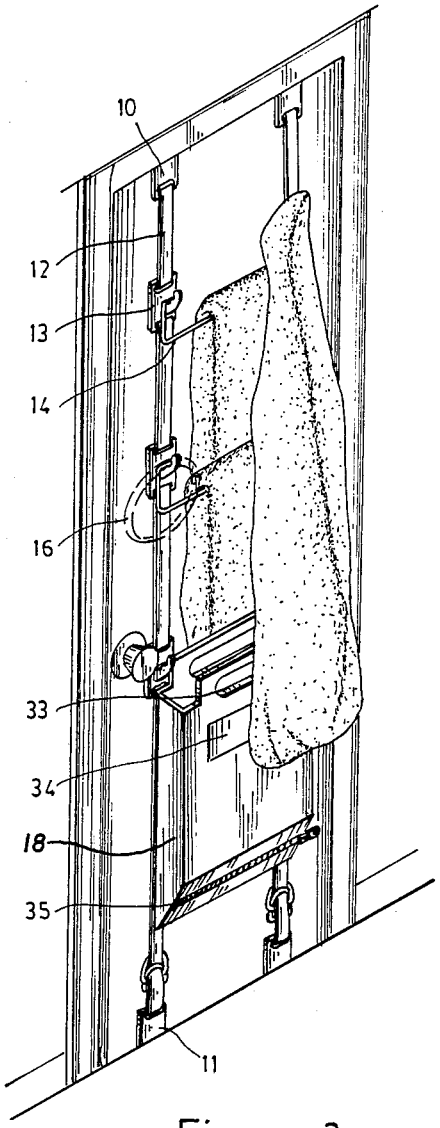
Figure 3:
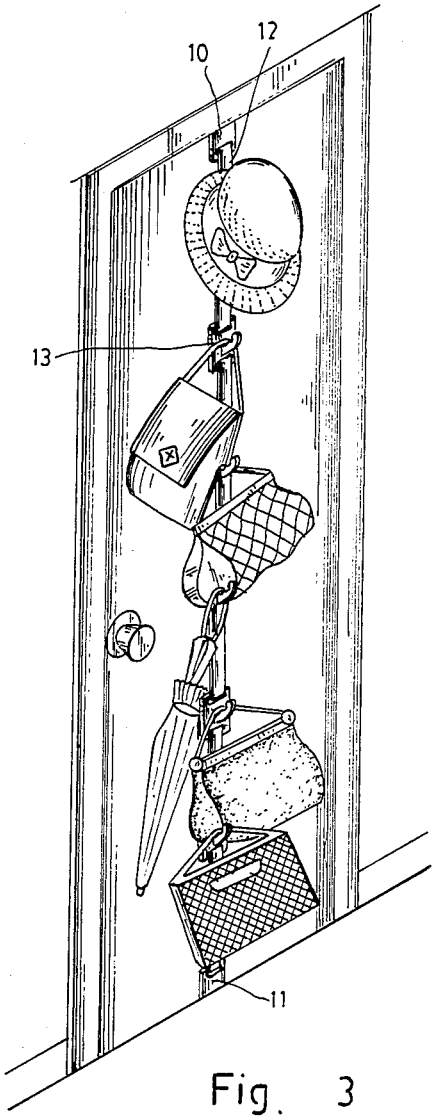
Figure 4:
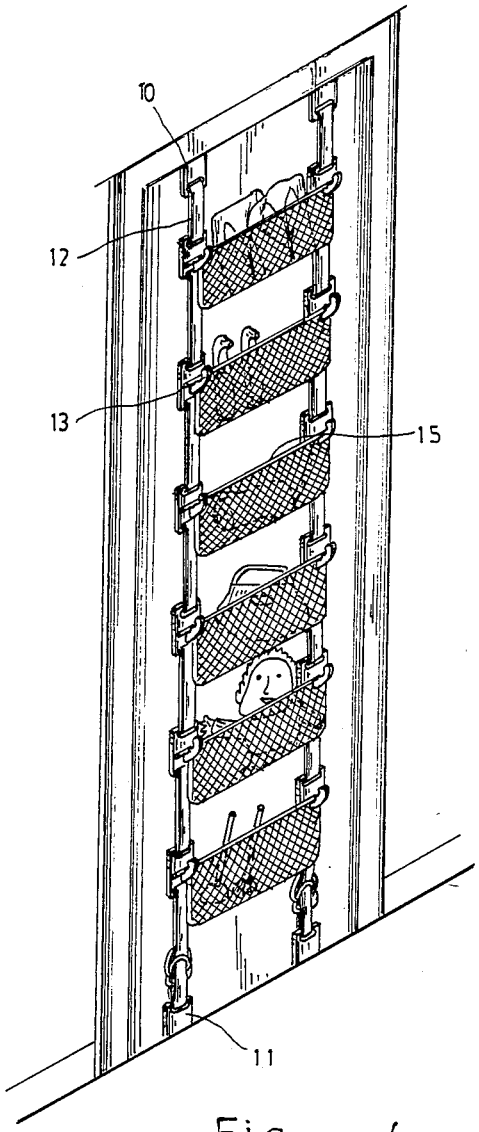

The present invention relates to a simple but convenient door back hanging organizer device and, more particularly, a flexible device adjustable according to requirements of the user for hanging clothes or articles. The present invention does not damage the door body which can happen with the installation of of conventional hanging hooks using nails or screws. The present invention also does not fall from the door which can happen with devices fastened by an adhesive.

The embodiment of the invention will now be described by way of example, reference being made to the accompanying drawing as previously described.

The hanging organizer according to the present invention, as shown in FIG. 1 and FIGS. 2–4, comprises upper and lower locating plates 10 and 11, a belt 12, a fixing plate 23, a cross hanging rod 14, a net bag 15, and a hanging ring 16. Each locating plate 10 and lower locating plate 11 respectively comprises two lines of bending holes 20 and 21 for selective bending of the locating plates at either line of the bending holes according to the thickness of the door body 22. After being bent, the locating plates 10 and 11 have an inverted U-shaped configuration for hanging on the upper and the lower end of the door body 22 respectively. The belt 12 can to be attached to the upper and lower locating plates 10 and 11 in a manner which permits flexible adjustment of its length and tension. The fixing plate 23 comprises a hook 13, and an upper slot 24 and a lower slot 25 for installation on the belt 12 by way of inserting the belt through the upper and lower slots 24 and 25. The hook 13 has a locating channel 26 for installation of a cross hanging rod 14 therewith, so that one matching pair of hooks 13 can be arranged respectively at right and left sides of a door and the cross hanging rod 14 can be attached therebetween by means of respective locating channels 26.

In order to match with application of the whole device, all the elements of the present invention are specifically arranged as described below: The inlet portion 36 of the hook 13 above the locating channel 26 is designed to have a narrower opening, so as to be capable of firmly securing the cross hanging rod 14 therein and to prevent the cross hanging rod 14 from falling out of channel 26 when clothes or articles are hung thereon or removed therefrom. The configuration of the cross hanging rod 14 is arranged to prevent the cross hanging rod 14 from falling due to rightward or leftward displacement. The belt 12 is designed to have four snap buttons 30 at each end for easy adjustment and installation. The belt also comprises a clamping ring 31 for adjusting the length and the tension of the belt 12 as required. The net bag 15 comprises an elastic band specially arranged with the bag in one consolidated unit. The retainer ring 32 of the net bag 15 is specially designed to provide maximum security. The laundry bag 18, includes grip holes 33 for convenient holding by the hands, an inlet 34 at its front for placing clothes therein, a zip fastener 35 at the bottom for convenient hanging of the laundry bag 18 and for easy removal of the clothes therefrom.

The present invention can be flexibly arranged on the door of a bed room or bath room, according to different purposes, in a one belt application or a double-belt application (as shown in FIGS. 2, 3, 4). By means of the flexible arrangement of the hook 13, cross hanging rod 14, hanging ring 16, net bag 15, a diversified hanging device can be formed for hanging towels, hats, umbrellas, clothes, washing bags, etc. and for fully utilizing the device.

In application, the hanging device, according to the present invention, can provide the following advantages:

1. Installation of the present hanging device does not damage the door, because no nail or screw is required. Also, it will not drop or fall from the door after installation, because no adhesive agent is used. 2. The hanging organizer device according to the present invention is very practicable and can be flexibly assembled and adjusted to match with different purposes of application.

I claim:

1. A door hanging organizer device comprising:

upper and lower locating plates, each having two rows of holes for providing selective bending at either row of holes and for selective bending of the upper and lower locating plates respectively into an inverted U- and an U-shaped configuration for installing the locating plates respectively on the top and bottom of a door, belt means for holding the upper and lower locating plates on the door, the belt means including a thin, flat belt attached to both the upper and lower locating plates and a clamping ring for adjusting length and tension of the belt, and a fixing plate having two closed slots at the top and bottom thereof for the belt to pass therethrough and a hook, the hook having a channel at an upper base portion thereof for receiving accessory items.

2. The device as claimed in claim 1, wherein a hanging ring is attached to one of the fixing plates by passing through the channel in the hook.

3. A combination of two door hanging organizer devices set forth in claim 1, the devices being arranged on left and right sides of the door, wherein a plurality of fixing plates are arranged on the left and right devices and at least one of a cross hanging rod and a net bag are arranged between a fixing plate on the left device and a fixing plate on the right device by a portion thereof passing through the channel in the fixing plate.

4. The combination as claimed in claim 3, wherein a hanging ring is attached to one of the fixing plates by passing through the channel in the hook.

5. The combination as claimed in claim 3, wherein both the cross hanging rod and net bag are respectively arranged between different fixing plates on the left device and on the right device.

6. The combination as claimed in claim 3, wherein a laundry bag is attached to the right and left devices at a respective fixing plate thereof.

7. The combination as claimed in claim 6, wherein the laundry bag has an inlet at its front for placing clothes therein and a zip fastener at its bottom for removing clothes therefrom.

* * * * *